US007490826B2

(12) United States Patent
Takai et al.

(10) Patent No.: US 7,490,826 B2
(45) Date of Patent: Feb. 17, 2009

(54) SHEET FEED APPARATUS

(75) Inventors: Shingo Takai, Ibaraki (JP); Yasushi Hashimoto, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 216 days.

(21) Appl. No.: 11/432,527

(22) Filed: May 12, 2006

(65) Prior Publication Data

US 2006/0267264 A1 Nov. 30, 2006

(30) Foreign Application Priority Data

May 27, 2005 (JP) ..... P2005-155461

(51) Int. Cl.
*B65H 3/14* (2006.01)

(52) U.S. Cl. ..... 271/98; 271/97; 271/104

(58) Field of Classification Search ..... 271/97, 271/98, 104

See application file for complete search history.

(56) References Cited

U.S. PATENT DOCUMENTS 4,887,805 A * 12/1989 Herbert et al. ..... 271/94
5,090,676 A 2/1992 Matsuno et al.
5,150,892 A * 9/1992 Shimizu ..... 271/98
5,181,706 A * 1/1993 Yamamoto et al. ..... 271/11
5,478,066 A * 12/1995 Yoshida et al. ..... 271/12
5,707,056 A * 1/1998 Rauen et al. ..... 271/96
5,921,540 A * 7/1999 Acquaviva et al. ..... 271/98
6,082,728 A * 7/2000 Ubayashi ..... 271/108
6,412,769 B1 * 7/2002 Goda et al. ..... 271/94
6,543,759 B2 * 4/2003 Yamaguchi et al. ..... 271/98
2002/0047235 A1 * 4/2002 Allner et al. ..... 271/98
2006/0170146 A1 * 8/2006 Kato ..... 271/97

FOREIGN PATENT DOCUMENTS

JP 2005-1855 1/2005

* cited by examiner

*Primary Examiner*—Patrick H Mackey
*Assistant Examiner*—Luis Gonzalez
(74) *Attorney, Agent, or Firm*—McGinn IP Law Group, PLLC

(57) ABSTRACT

A sheet feed apparatus including: a sheet storage tray that store a plurality of sheets; an suction belt that suctions an uppermost one of the sheets and conveys the sheet along a sheet conveyance surface; a nozzle including, first ejection openings that are disposed on both side ends across a substantially center portion of the suction belt and eject air toward the plurality of sheets, and a second ejection opening that is disposed at the substantially center portion of the suction belt and ejects air toward the suction belt; and a projecting member that projects downward with respect to the sheet conveyance surface, the projecting member being provided at a position opposite the nozzle with respect to the suction belt.

11 Claims, 3 Drawing Sheets

SHEET FEED APPARATUS

BACKGROUND OF THE INVENTION

1. Field of the Invention

The present invention relates to a sheet feed apparatus in an electrophotographic apparatus, and more particular to a sheet feed apparatus that uses airflow.

2. Description of the Related Art

FIG. 1 shows a configuration of a sheet feed apparatus that uses airflow in the existing electrophotographic apparatus, i.e., an apparatus which is generally called an airflow type sheet feed apparatus or an air pick sheet feed apparatus. In FIG. 1, sheets 2 loaded on a sheet lifting table 1 are controlled in such a way as to be constantly positioned at a fixed height, by a sheet upper surface detection sensor 3 and a controller 4. The controller 4 controls the driving of the sheet lifting table 1 based on information from the sheet upper surface detection sensor 3. A suction chamber 5, a belt member, which is generally called a suction belt 6, a plurality of holes through which air passes, and a driving device 7 for driving the suction belt 6 are located above the sheets 2. A nozzle 8 that causes an upper layer portion of the loaded sheets 2 to hover by air blowing is provided at a front of the sheets 2 in a conveyance direction. A sheet feeding is carried out as the suction belt 6 suctions and conveys the sheets 2 caused to hover by the nozzle 8. Also, a conveyance roller 21, a sheet conveyor, that receives the suctioned sheets 2 and conveys them to a not-shown image forming section, is provided downstream of the nozzle 8 in the sheet conveyance direction. In such a sheet feed apparatus, various devices have heretofore been made to obtain a sufficient sheet separation effect by the air blowing, i.e., to prevent multifeeding of sheet.

For example, as shown in FIG. 2, the nozzle 8 is configured to be divided into a first ejection opening 9 and a second ejection opening 10. The first ejection opening is located on both side ends across an approximate center of the suction belt 6 and ejects air. The second ejection opening 10 is located on a substantially center portion of the suction belt 6 and ejects air toward the suction belt 6. The arrangement is thus such that the first ejection opening 9 mainly causes the sheets 2 to hover, while the second ejection opening 10 blows air between the suction belt 6 and the uppermost sheet, so that the uppermost sheet is separated from the next sheet, thereby obtaining a sufficient sheet separation effect (e.g., refer to U.S. Pat. No. 5,090,676 and JP-A-2005-1855).

SUMMARY OF THE INVENTION

In recent years, as prints become diverse, a sheet feed apparatus that uses airflow has required increasingly higher performance. Besides, in using a certain kinds of sheets, the case has occurred where sufficient separation performance cannot be obtained only by dividing the function of the air ejection opening.

The present invention has been made in view of above circumstances and provides a sheet feed apparatus that uses airflow. According to an aspect of the invention, an auxiliary member is added to the sheet feed apparatus in order to improve sheet separation performance. According to another aspect of the invention the auxiliary member also has function of detecting an abnormal operation of the apparatus, and thereby the number of parts reduces and a reduction in cost of the apparatus is achieved. According to a further aspect of the invention, the sheet feed apparatus avoids deterioration of the operability in stead of the addition of the auxiliary member.

According to a first aspect of the invention, there is provided a sheet feed apparatus including: a sheet storage tray that store a plurality of sheets; an suction belt that suctions an uppermost one of the sheets and conveys the sheet along a sheet conveyance surface; a nozzle including, first ejection openings that are disposed on both side ends across a substantially center portion of the suction belt and eject air toward the plurality of sheets, and a second ejection opening that is disposed at the substantially center portion of the suction belt and ejects air toward the suction belt; and a projecting member that projects downward with respect to the sheet conveyance surface, the projecting member being provided at a position opposite the nozzle with respect to the suction belt.

The projecting member may be configured to be movable in a direction perpendicular to the sheet conveyance surface. Also, the sheet feed apparatus may further includes a sensor that detects a movement of the projecting member.

Also, a sheet feed apparatus may further includes a holder that keeps a positional relation between the projecting member and the sensor, on which the projecting member and the sensor are provided. Also, the holder may be configured to movable in the direction perpendicular to the sheet conveyance surface in conjunction with a movement of the sheet storage tray, in a direction parallel to the sheet conveyance surface.

According to the above configuration, in the course of sheet hovering, the substantially center portion of the sheets comes into contact with the projecting member to restrain the hovering, while a portion not in contact with the projecting member is not restrained. Therefore, a difference in hovering height occurs therebetween, whereby the substantially center portion is formed in an overall depressed, curved shape, thus making it easy for the air from the second ejection opening of the nozzle to flow between the sheets and the suction belt. By this means, it is possible to improve sheet separation performance. Also, in the event that the projecting member is configured in such a way as to move in an up and down direction, and that the sensor which detects the up and down movement is installed, it is possible to detect an abnormal operation such as the sheet loading table running out of control. Thus, one mechanism is allowed to have a plurality of functions, thereby achieving a reduction in cost of the whole apparatus. Furthermore, in a case of the apparatus in which the sheet storage tray moves horizontally like a drawer, because of a relationship between the projecting member and the suction belt and between the projecting member and a sheet loading position, the projecting member may stand in the way when user supplies the sheet storage tray with sheets, whereby there is the possibility of a deterioration in operability. However, as the holder can be retracted in conjunction with the in and out movement of the sheet storage tray, it is possible to prevent a deterioration in the operability of the apparatus.

DETAILED DESCRIPTION OF THE INVENTION

An embodiment of the invention will hereafter be described with reference to the drawings.

Embodiment 1

Figure 1:
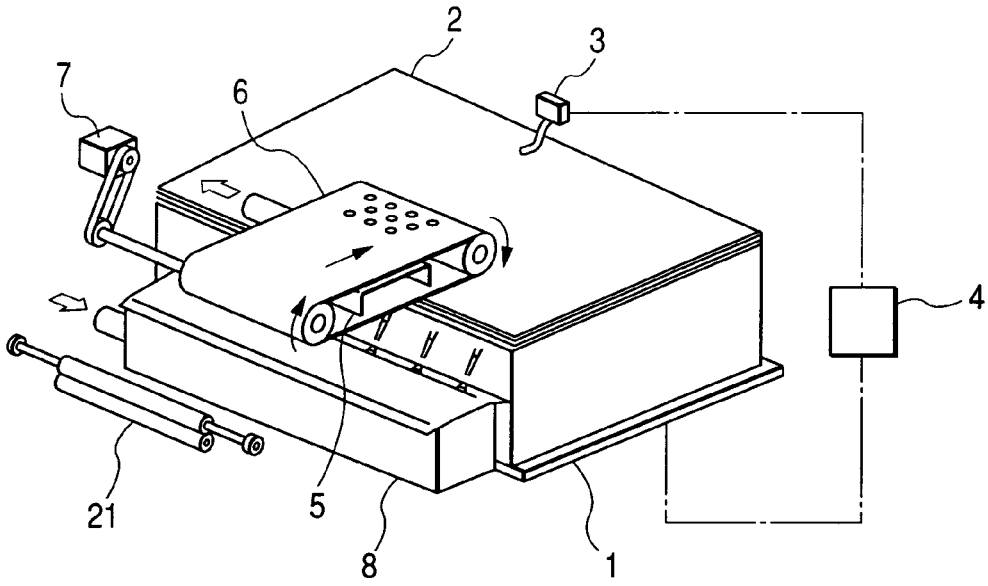
FIG. 1 is an illustration showing an existing sheet feed apparatus that uses airflow.
Figure 2:
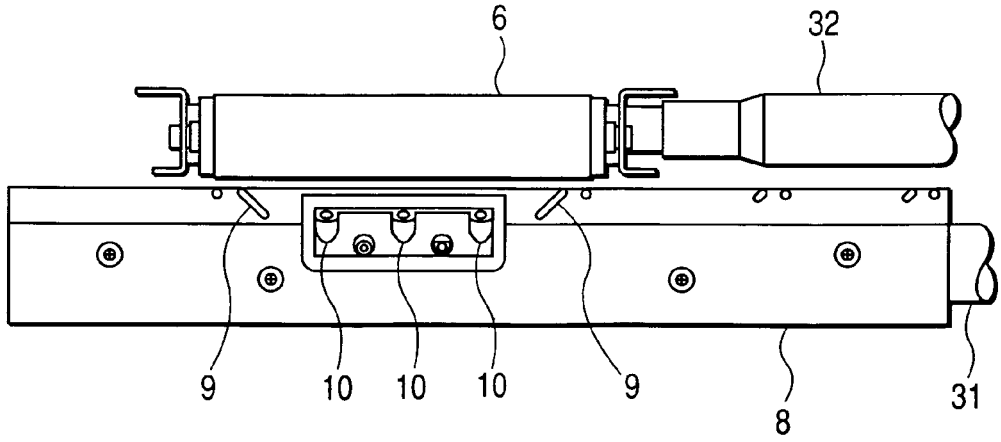
FIG. 2 is an illustration showing the existing sheet feed apparatus that uses airflow.
Figure 3:
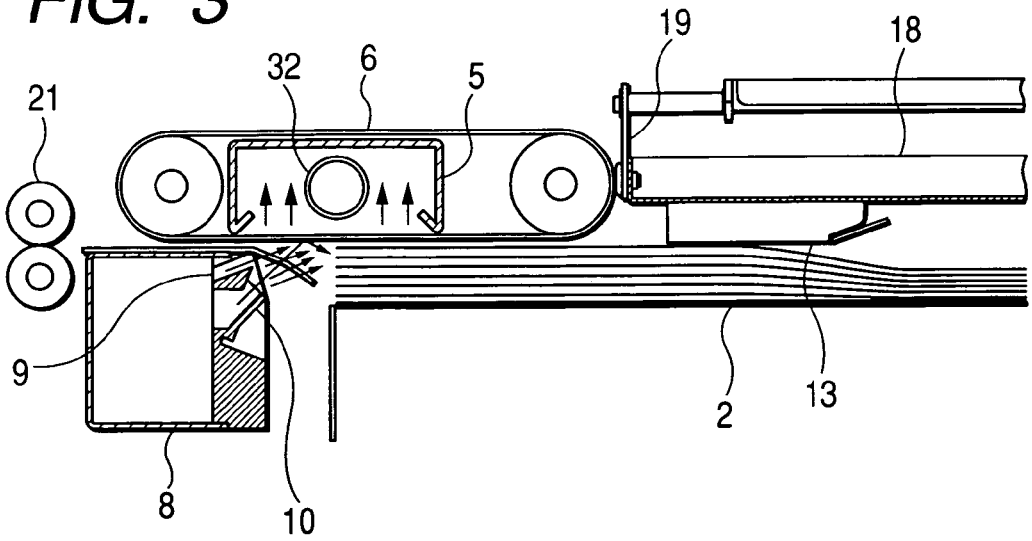
FIG. 3 is a side view showing a sheet feed apparatus according to an embodiment of the invention.
Figure 4:
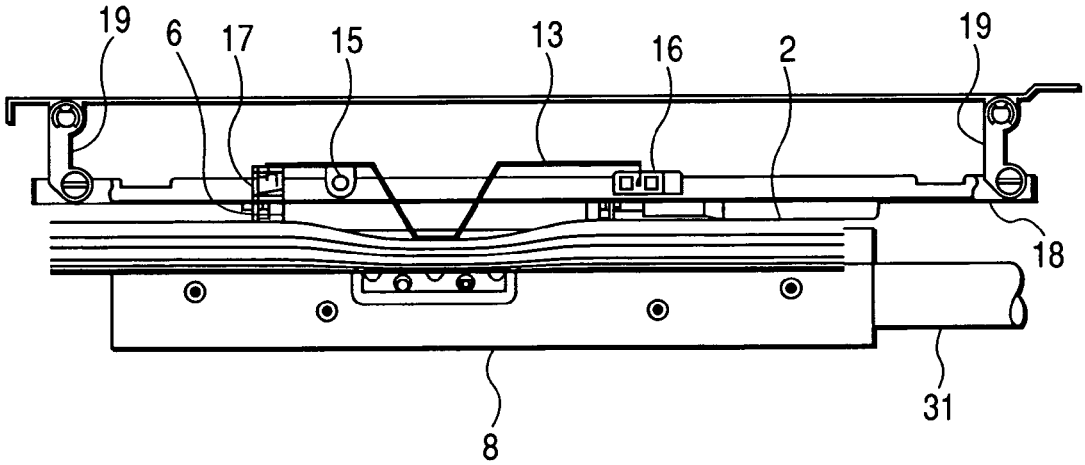
FIG. 4 is a sectional view showing the sheet feed apparatus according to the embodiment of the invention.

In FIGS. 3 and 4, reference numeral 2 denotes sheets, 6 denotes a suction belt, and 8 denotes a nozzle including a first ejection opening 9 from which air is ejected toward the upper layer portion of the sheets, and a second ejection opening 10 from which air is ejected toward the suction belt 6. Air is supplied to the nozzle 8 through a duct 31 from a not-shown blower. Also, the suction belt 6 is configured to rotate in contact with an opening of a suction chamber 5 into which air is suctioned through a duct 32 that is arranged to suction the sheets 2 through holes made in the surface of the suction belt 6.

Figure 5:
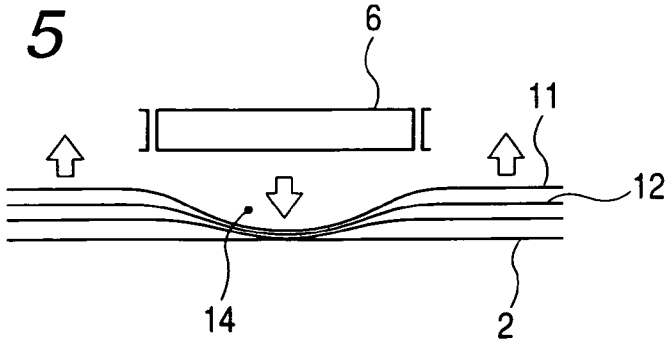
FIG. 5 is a schematic view showing a principle of the sheet feed apparatus that uses airflow.

In a sheet feed apparatus configured as above, an operation of feeding the sheets 2 will be described with reference to schematic views in FIGS. 5 to 8. Firstly, as shown in FIG. 5, air is ejected from the first ejection opening 9, thereby causing the sheets 2 to hover at both ends where one sheet is being separated from another. At the same time, the sheets 2 are formed in a shape in which the center thereof is depressed downward by the air from the second ejection opening 10, thus forming a pocket 14 in the center of the suction belt 6.

Figure 6:
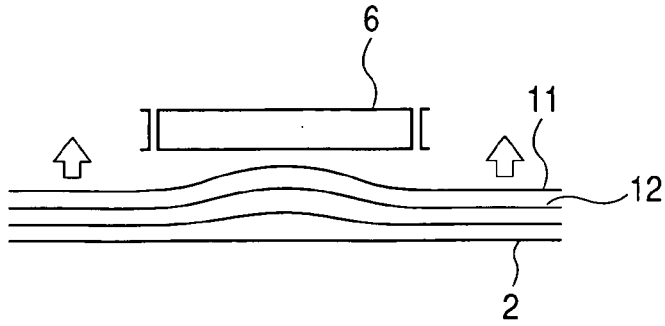
FIG. 6 is a schematic view showing the principle of the sheet feed apparatus that uses airflow.

In this condition, when the holes in the suction belt 6 are positioned at the opening of the suction chamber 5 to start air suction, as shown in FIG. 6, the uppermost sheet, i.e., a first sheet 11 starts to rise, along with which sheets below the first sheet 11 also start to rise. In the course of an access of the first sheet 11 to the suction belt 6, as shown in FIG. 7, the air from the second ejection opening 10 enters between the first sheet 11 and a second sheet 12, whereby the first sheet 11 and the second sheet 12 are completely separated from one another.

Figure 7:
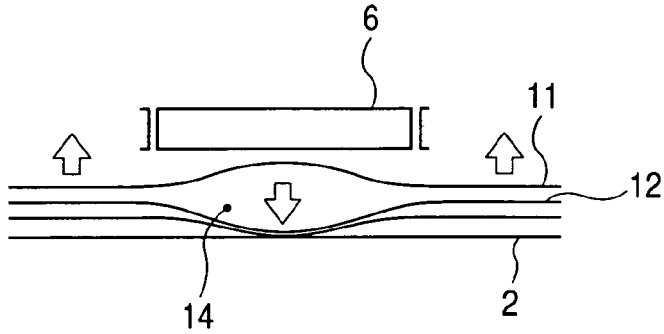
FIG. 7 is a schematic view showing the principle of the sheet feed apparatus that uses airflow.

Thereafter, as shown in FIG. 7, the first sheet 11 which has reached the suction belt 6 is conveyed by the rotation of the suction belt 6 along a sheet conveyance surface. At this time, since the second sheet 12 and the subsequent sheets are held downward at the edge by the air from the second ejection opening 10, a phenomenon in which the second sheet 12 and the subsequent sheets are dragged out by the first sheet, i.e. so-called multifeeding, is avoided.

A first essential point of this series of sheet feed operation is that the separation and hovering of the sheets by the first ejection opening 9 is carried out to a satisfactory extent. Unless an appropriate air gap is formed between the hovering sheets, in the course of the first sheet 11 being suctioned by the suction belt 6, the sheets hover in a bunch more frequently so that the multifeeding occurs more frequently. Also, a second essential point is that the air from the second ejection opening flows smoothly between the suction belt 6 and the first sheet 11, and that the first sheet 11 and the second sheet 12 are sufficiently separated-from one another. Unless this separation is carried out to a satisfactory extent, the multifeeding occurs at high frequency. Then, it is essential that an inflow opening, i.e., the pocket 14, into which the air from the second ejection opening flows, is formed. Particularly, in the case where the sheets have a deformation such as a curl or a wave due to an environmental change such as moisture absorption, since the hovering balance of the sheets deteriorates, the case occurs in which no pocket is formed in the center of the suction belt 6.

Figure 8:
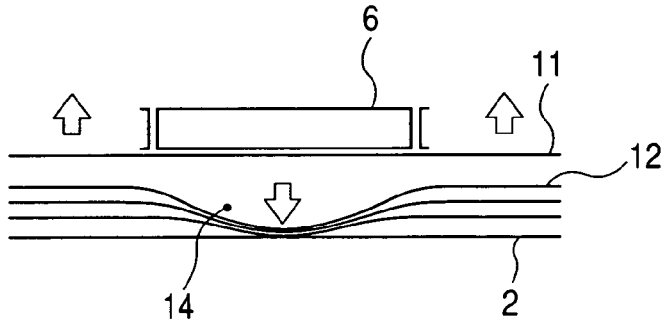
FIG. 8 is a schematic view showing the principle of the sheet feed apparatus that uses airflow.

Therefore, in the embodiment of the invention, as shown in FIGS. 3 and 4, a projecting member 13, which has a shape projecting downwardly from the sheet conveyance surface of the suction belt 6, is disposed across the suction belt 6 from the nozzle 8, wherein the substantially center portion of the sheets comes into contact with the projecting member 13 in the course of the hovering and suction of the sheets 2, thus forming a downwardly depressed, curved shape. By this means, even in the event that a curl or wave form occurs in the sheets, the sheets are formed in the downwardly depressed, curved shape, whereby the pocket 14 shown in FIGS. 5, 7 and 8 is formed in the center of the suction belt 6, thus separation performance improves.

Regarding the amount of projection of the projecting member 13 with respect to the suction belt 6, a proper value thereof exists in accordance with the type of sheets in use and other setting conditions. However, in the case of this embodiment, when sheet having a thickness of 64 to 200 ($g/m^2$) is used and the amount of projection is set to 2 to 3 mm, a satisfactory result was obtained.

Also, in this embodiment, a rotatable hinge 15 is provided on the projecting member 13, wherein the projecting member 13 is configured to rotate in an up and down direction, and furthermore, a sensor 16 that detects the position of the projecting member 13 is installed.

A spring 17 is attached to an end of the projecting member 13 in such a way that its force acts in a direction in which the projecting member 13 rotates downwardly. The force by the spring 17 is adjusted to such an extent as to securely prevent the projecting member 13 from moving even in the case where the projecting member 13 is pushed upward by the hovering force of the sheets 2. And the projecting member is configured to stabilize during printing. With such a configuration, for example, in the case where a sheet loading table runs out of control for some reasons, i.e., an abnormal operation occurs in the sheet loading table, the projecting member 13 is pushed up by the abnormal operation and the sensor 16 detects the motion, thereby making it possible to control the sheet loading table via a control mechanism.

Figure 9:
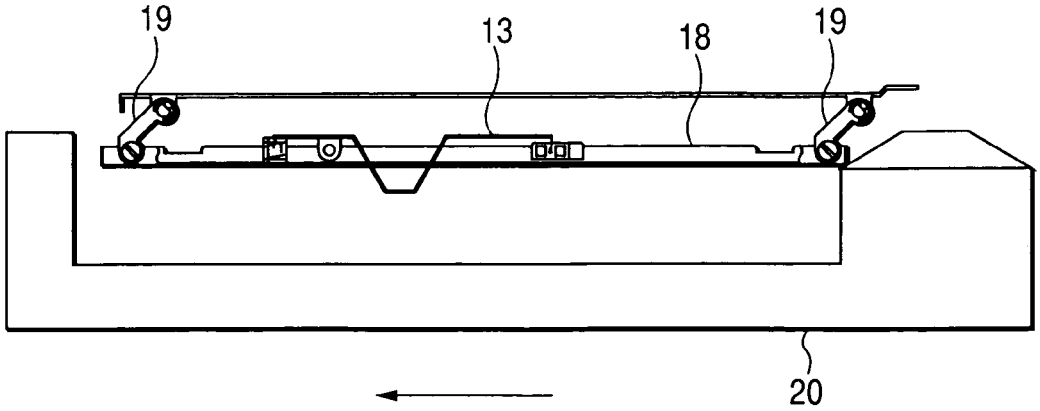
FIG. 9 is a side view showing the sheet feed apparatus according to the embodiment of the invention.

Also, in a case where the projecting member is installed in the sheet feed apparatus described in this embodiment, because of a positioning relationship between the height of sheets loaded and the projecting member 13 and between the position of the suction belt 6 and the projecting member 13, the problem may occur that, at the time of opening/closing of a sheet loading tray, the projecting member 13 interferes with the components of the sheet loading tray. However, as shown in FIG. 4, in this embodiment, a rotary hinge 19 is provided on a holder 18 that holds components such as the projecting member 13 and the sensor, wherein the holder 18 is configured to retract upward at the time of opening/closing of the sheet loading tray 20, as shown in FIG. 9. By this means, it is possible to add an auxiliary member without deteriorating the operability of the apparatus.

The entire disclosure of Japanese Patent Application No. 2005-155461 filed on May 27, 2005 including specification, claims, drawings and abstract is incorporated herein be reference in its entirety.

What is claimed is:

1. A sheet feed apparatus comprising:

a sheet storage tray that stores a plurality of sheets;

a suction belt that suctions an uppermost sheet of the plurality of sheets and conveys the uppermost sheet along a sheet conveyance surface;

a nozzle, comprising:

first ejection openings that are disposed on side ends across a substantially center portion of the suction belt and eject air toward the plurality of sheets; and a second ejection opening that is disposed at the substantially center portion of the suction belt and ejects air toward the suction belt;

a projecting member that projects downwardly with respect to the sheet conveyance surface and contacts the uppermost sheet in a course of a hovering of the uppermost sheet, to form a pocket in a substantially center portion of the uppermost sheet, the projecting member being provided at a position opposite the nozzle with respect to the suction belt; and a sensor that detects a movement of the projecting member, wherein the suction belt suctions the uppermost sheet from a sheet loading surface provided in the sheet storage tray, wherein a lower end of the projecting member is positioned between the sheet conveyance surface and the sheet loading surface, and wherein the projecting member is configured to be movable in a direction perpendicular to the sheet conveyance surface.

2. A sheet feed apparatus according to claim 1, further comprising:

a holder tat keeps a positional relation between the projecting member and the sensor, wherein the projecting member and the sensor are provided on the holder, and wherein the holder is configured to movable in the direction perpendicular to the sheet conveyance surface in conjunction with a movement of the sheet storage tray in a direction parallel to the sheet conveyance surface.

3. The sheet feed apparatus according to claim 1, wherein the projecting member projects downwardly with respect to the sheet conveyance surface in a projecting amount in a range from 2 mm to 3 mm.

4. The sheet feed apparatus according to claim 1, wherein the projecting member suppresses a hovering of a part of the plurality of sheets.

5. The sheet feed apparatus according to claim 1, wherein the plurality of sheets comprise a downwardly depressed, curved shape as a result of the pocket being formed by the projecting member.

6. The sheet feed apparatus according to claim 1, wherein the plurality of sheets comprise portions other than the substantially center portion, and wherein said portions other than the substantially center portion of the plurality of sheets are unrestrained by the projecting member.

7. The sheet feed apparatus according to claim 1, wherein the projecting member comprises a trapezoidal shape, wherein a gap is formed in a long side of said trapezoidal shape, and wherein a short side of said trapezoidal shape contacts said substantially center portion of said plurality of sheets.

8. A sheet feed apparatus comprising:

a sheet storage tray that stores a plurality of sheets;

a suction belt that suctions an uppermost sheet of the plurality of sheets and conveys the uppermost sheet along a sheet conveyance surface;

a nozzle, comprising:

first ejection openings that are disposed on side ends across a substantially center portion of the suction belt and eject air toward the plurality of sheets; and a second ejection opening that is disposed at the substantially center portion of the suction belt and ejects air toward the suction belt;

a projecting member that projects downwardly with respect to the sheet conveyance surface and contacts the uppermost sheet in a course of a hovering of the uppermost sheet, to form a pocket in a substantially center portion of the uppermost sheet, the projecting member being provided at a position opposite the nozzle with respect to the suction belt, said projecting member configured to be moveable in a direction perpendicular to the sheet conveyance surface; and a rotatable hinge formed on said projecting member that moves said projecting member in said direction perpendicular to the sheet conveyance surface, wherein the suction belt suctions the uppermost sheet from a sheet loading surface provided in the sheet storage tray, and wherein a lower end of the projecting member is positioned between the sheet conveyance surface and the sheet loading surface.

9. The sheet feed apparatus according to claim 1, further comprising:

a spring formed on an end of said projecting member such that a force of the spring acts in a direction in which said projecting member rotates downwardly, wherein the force of the spring is adjusted such that the projecting member is securely prevented from moving.

10. The sheet feed apparatus according to claim 1, wherein the projecting member stabilizes during a printing operation.

11. The sheet feed apparatus according to claim 2, further comprising:

a rotary hinge provided on said holder that holds said projecting member and said sensor, wherein said holder retracts upwardly at a time of an opening and closing of said sheet storage tray.

* * * * *